US010610869B2

(12) United States Patent
Belotserkovsky

(10) Patent No.: US 10,610,869 B2
(45) Date of Patent: Apr. 7, 2020

(54) INERTIAL CONE CRUSHER WITH AN UPGRADED DRIVE

(71) Applicant: Mikhail Konstantinovich Belotserkovsky, St. Petersburg (RU)

(72) Inventor: Konstantin Evseevich Belotserkovsky, St. Petersburg (RU)

(73) Assignee: Mikhail Konstantinovich Belotserkovsky, St. Petersburg (RU)

( * ) Notice: Subject to any disclaimer, the term of this patent is extended or adjusted under 35 U.S.C. 154(b) by 379 days.

(21) Appl. No.: 15/552,385

(22) PCT Filed: Mar. 3, 2016

(86) PCT No.: PCT/RU2016/000113
§ 371 (c)(1),
(2) Date: Aug. 21, 2017

(87) PCT Pub. No.: WO2016/148604
PCT Pub. Date: Sep. 22, 2016

(65) Prior Publication Data

US 2018/0021785 A1 Jan. 25, 2018

(30) Foreign Application Priority Data

Mar. 13, 2015 (RU) ..... 2015108963

(51) Int. Cl.
*B02C 2/00* (2006.01)
*B02C 2/04* (2006.01)
*B02C 2/02* (2006.01)

(52) U.S. Cl.
CPC ..... *B02C 2/042* (2013.01); *B02C 2/00* (2013.01); *B02C 2/02* (2013.01); *B02C 2/04* (2013.01)

(58) Field of Classification Search
CPC .. B02C 2/042; B02C 2/02; B02C 2/04; B02C 2/00
See application file for complete search history.

(56) References Cited

U.S. PATENT DOCUMENTS 1,553,333 A * 9/1925 Sholl ..... B02C 2/06 241/210
1,799,476 A * 4/1931 Newhouse ..... B02C 2/06 241/209

(Continued)

FOREIGN PATENT DOCUMENTS

JP 2001276637 A 10/2001
RU 2011129618 A 1/2013

(Continued)

OTHER PUBLICATIONS

Search Report in PCT/RU2016/000113, dated Aug. 25, 2016.

*Primary Examiner* — Faye Francis
(74) *Attorney, Agent, or Firm* — Bardmesser Law Group

(57) ABSTRACT

A cone crusher includes body installed on foundation with resilient dampers and having an outer cone and an inner cone. Unbalance weight is on the drive shaft of inner cone using a slide bushing, with center of gravity adjustable relative to rotation axis, slide damper of unbalance weight connected to transmission coupler, through which torque is transmitted. Transmission coupler is a disc coupler comprising a drive half-coupler, a driven half-coupler, and a floating disc between them. The driven half-coupler is rigidly connected to slide bushing, and the drive half-coupler, to gear rigidly connected to counterbalance weight. The drive half-coupler, gear and counterbalance weight are mounted on the slide bushing, and driving half-coupler, gear, counterbalance weight, and the slide bushing form one movable dynamic (Continued)

assembly, installed using a mounting disc, on fixed rotation axis, which rests upon flange rigidly fixed in the bottom part of body of the crusher.

19 Claims, 7 Drawing Sheets

(56) References Cited

U.S. PATENT DOCUMENTS 1,936,728 A * 11/1933 McCaskell ..... B02C 2/06 241/209
3,809,324 A * 5/1974 Cook ..... B02C 2/06 241/210
3,908,916 A * 9/1975 Klushantsev ..... B02C 2/06 241/213
4,073,446 A * 2/1978 Rundkvist ..... B02C 2/042 241/207
4,463,908 A * 8/1984 Ivanov ..... B02C 2/045 241/207
4,566,638 A * 1/1986 Lundin ..... B02C 2/06 241/210
5,950,939 A * 9/1999 Drinkwater ..... B02C 2/04 241/207
6,446,892 B1 * 9/2002 Fasoli ..... B02C 2/04 241/207
7,048,214 B2 * 5/2006 Johnson ..... B02C 2/00 241/207
8,800,904 B2 * 8/2014 Belotserkovskiy ..... B02C 2/042 241/207
9,149,812 B2 * 10/2015 Belotserkovskiy ..... B02C 2/042
9,199,244 B2 * 12/2015 Belotserkovskiy ..... B02C 2/042
9,283,568 B2 * 3/2016 Belotserkovskiy ..... B02C 2/04
2012/0006923 A1 * 1/2012 Belotserkovskiy ..... B02C 2/042 241/207
2014/0103150 A1 * 4/2014 Belotserkovskiy ..... B02C 2/042 241/27
2014/0117127 A1 * 5/2014 Belotserkovskiy ..... B02C 2/042 241/24.25
2014/0306040 A1 * 10/2014 Belotserkovskiy ..... B02C 25/00 241/30

FOREIGN PATENT DOCUMENTS

SU 886971 A1 12/1981
WO 2012005650 A1 1/2012
WO 2013052792 A1 4/2013

* cited by examiner

INERTIAL CONE CRUSHER WITH AN UPGRADED DRIVE

CROSS REFERENCE TO RELATED APPLICATIONS

This application is a US National Phase of PCT/RU2016/000113, filed on Mar. 3, 2016, which claims priority to RU patent application No. 2015108963, filed on Mar. 13, 2015, both of which are incorporated herein by reference in their entirety.

BACKGROUND OF THE INVENTION

Field of the Invention

The invention relates to the field of heavy engineering, to crushing and grinding equipment, and more particularly, to cone crushers, and can be used in industrial processes of the construction and mining/enrichment industry.

Description of the Related Art

Currently, an inertial cone crusher is the most widespread and universal machine for crushing materials. In its design, the machine is a complex and labor-consuming in operation, but works efficiently with good process performances. The main problem in improving its design is the necessity to combine high operating abilities with reliability, economy, failure safety, and requirements for easy operation and maintenance.

The related theory has been described in the literature, for instance in the book "Production of Cubiform Crushed Stone and Construction Sand Using Vibration Crushers," by V. A. Arsentiev et al., St. Petersburg, VSEGEI Publishers, 2004, ISBN 93761-061-X, which has a chapter entitled "Basics of Dynamic and Technological Calculation of Inertial cone crushers," p. 64 {1}. An inertial cone crusher comprises a body with an outer cone and an inner cone arranged inside it, whose surfaces, when facing each other, form a crushing chamber. Installed on the drive shaft of the movable inner cone is an unbalance weight rotated by a transmission. When the unbalance weight rotates, a centrifugal force is generated, making the inner cone roll without a gap between it and the outer cone, if the crushing chamber contains no material to be processed (running idle); or over a layer of material to be crushed.

For dynamic balance, the crusher design is supplemented with a counterbalance, in other words an additional unbalance weight, which is installed in phase opposition to the unbalance weight and generates its own centrifugal force directed opposite to the centrifugal forces of the inner cone and its unbalance weight. The forces compensate each other, which results in lower vibration loads on the crusher's components, primarily on the body. An important component of the cone crusher design is the technique and device used to transmit torque from the engine to the unbalance weight, in other words, the transmission assembly. In a general case, the transmission assembly must ensure the required rotation speed, being at the same time reliable, compact, and economically feasible in terms of the costs of its manufacturing, installation, and maintenance. The process parameters of an inertial cone crusher can be improved by dynamic balance improvements and by updating the transmission subassembly.

The use of a support and drive ball spindle as a transmission assembly is known. The related theory has been described in the literature: "Vibration Crushers," Vaisberg L. A. et al., VSEGEI Publishers, St. Petersburg, 2004, ISBN 93761-061-X, Calculation of Driving Elements for Irregular Rolling of the Inner Cone, p. 89, also FIGS. 33 and 34 {2}.

The design of a support and drive ball spindle is based on the Universal Joint proposed by A. Rzeppa in 1933, see U.S. Pat. No. 2,010,899. The joint comprises two cams, an inner one connected to a drive shaft and an outer one connected to a driven shaft. Both cams have six toroidal grooves, each arranged in planes extending through the shafts' axes. Placed in the grooves are balls whose position is preset by a separator interacting with the shafts via a separating lever. One end of the lever is pressed with a spring to the inner cam socket, and the other one slides in the cylindrical opening of the driven shaft. When the shafts' relative position changes, the lever tilts and turns the separator, which in turn changes the balls' position to place them in a bisector plane. In the given joint, torque is transmitted via all six balls.

WO 2012/005650 A1, entitled "Inertial cone crusher and method of balancing such crusher", Sep. 7, 2010, SE 20100050771, describes an inertial cone crusher that comprises a body, an outer cone, an inner shell with an unbalance weight installed on its shaft; and a system of counterbalance weights consisting of two separate parts. One part of the counterbalance weight is attached to the drive shaft below the drive shaft bearing and is arranged outside and below the crusher body, while the other part of the counterbalance weight is attached to the drive shaft above the bearing and is arranged inside the crusher body. The total weight of both counterbalance weights and the weight of each of them separately are calculated so that they should meet the values needed to generate the required centrifugal force, and to solve the problem of harmonization and dynamic balance of the unbalance weight and counterbalance weight. Such technical approach enables solving a broad range of aspects of the crusher's dynamic balance by modifying the ratio of weights of the counterbalance weight parts, relationship of the counterbalance weight parts, and their relationship with the unbalance weight. An advantage of such double distribution of the weights of the counterbalance weight is that the loads on the drive shaft bearing are reduced and are distributed more uniformly, and thus the bearing's service life is extended.

According to WO 2012/005650 A1, a bearing and compensation ball coupler is used as the transmission subassembly. A bearing and compensation ball coupler consists of a vertically oriented bearing drive spindle inserted into the driving half-coupler on the one side, and into the driven half-coupler from the other side. Each half-coupler is provided with six semi-cylindrical grooves, six hemispherical recesses provided on each spindle nose to mate the semi-cylindrical grooves, and six balls are inserted in each respective recess-groove pair. The lower half-coupler receives torque from the drive shaft and rotates the spindle, which in its turn rotates the driven half-coupler and the unbalance weight connected thereto.

A drawback of the above-described solution is the arrangement of the lower counterbalance weight at a level that is much lower than the level of the body bottom, under which the pulley shaft and the drive pulley itself are accommodated in their turn. To transmit torque, the engine may be connected to the pulley, for instance via a V-belt transmission. Therefore, a space must be provided strictly below, in an area under the crusher body, to accommodate the counterbalance weight proper, pulley and its shaft, drive, and engine, also providing an access area for adjustments and maintenance. Such a design also suggests combining the service area and the finished product unloading area, which is inefficient and obstructs the work of service personnel. Besides, such arrangement of drive components outside the basic body increases the height of the entire unit structure, while height is a critical parameter affecting the height of the whole material grinding process flow. Therefore, the crusher's height should be retained within the preset limits as far as possible, and at the best case it should be reduced, as the design permits.

Major drawbacks of the double counterbalance weight system are, evidently, a double cost of its manufacturing, and additional costs of installation, control, and maintenance. The use of a bearing and compensation ball coupler as a transmission generally, and in the prior art specifically, has the following drawbacks.

In the coupler, at any particular moment of time and at each particular angle of deflection of the shafts, torque is only transmitted with the aid of two balls on the strain axis, while the other two ball pairs are not loaded. The active pair of balls receives the whole load and presses into their respective semi-cylindrical grooves with an increased force, which results in rapid wear of the half-couplers and their breakdown. Non-uniform load distribution and limited area of the balls' working contact eventually results in a collapse of the balls themselves. Since the spindle nose is completely enclosed in the half-coupler, the wear of the coupler's inner components cannot be monitored visually. Gradual unmonitored wear leads to violations of the device's geometry, which in turn results in limitations on the value of torque to be transmitted, and finally in a complete and usually emergency (unpredictable) failure of the entire transmission subassembly and shutdown of the unit.

SUMMARY OF THE INVENTION

On the basis of the above, an object of this invention is improvement of the crusher by a change in the transmission subassembly design, change in the counterbalance weight assembly design, and reduction of the total height of the unit.

This object can be achieved by solving the following problems:

- developing an improved design of the counterbalance weight assembly, which must generate the required value of centrifugal force compensating for the centrifugal force generated by the unbalance weight;
- arranging the counterbalance weight assembly so that it should not require a specially outfitted area under the crusher unit;
- the counterbalance weight assembly must be arranged within the existing crusher's body;
- the method and place of installation of the counterbalance weight assembly must not increase the overall dimensions of the crusher unit in terms of height or width;
- the transmission subassembly must ensure transmission of torque from the drive to the unbalance weight bushing at any position of the inner cone shaft axis, and at any position of the inner cone shaft axis and unbalance weight, in case of uncrushable bodies getting into the crushing chamber, when the unbalance weight bushing must rotate about the fixed shaft of the inner cone being in an unpredictable position;
- the updated assemblies must have a reliable and easy-to-manufacture design, at least not increasing the cost of the crusher;
- the updated assemblies must make maintenance of the crusher simpler, faster, and less expensive.

To solve the above problems, it is proposed to integrate a transmission disc coupler into the crusher design, providing an integral compact "dynamic assembly" able to simultaneously provide dynamic balancing and torque transmission at any position of the crusher's subassemblies.

It is proposed to select a compensation disc coupler, which was first claimed by engineer John Oldham, of Ireland, in 1820, as the basis for the new transmission subassembly design. Other names of similar devices used in the literature are "double-slider coupling," "cross-link coupling," or "Oldham coupler." Detailed information on the coupler is presented in Wikipedia: en.wikipedia.org/wiki/Coupling#Oldham. The Oldham coupler transmits torque from a drive shaft to a driven shaft arranged in parallel, and enables compensating for radial displacement of the shafts' rotation axes. The coupler comprises two disc-shaped half-couplers, namely a driving half-coupler connected to the drive shaft and a driven half-coupler connected to the driven shaft, with an intermediate floating disc between them. Each half-coupler has a radial dowel pin on the working end surface, and the floating disc has radial dowel grooves perpendicular to each other on both end surfaces of the disc.

All the end surfaces of the parts are flat. In the operating position, the half-couplers' dowels enter the floating disc grooves so that the dowel-and-groove pair of the driving half-coupler is perpendicular to the dowel-and-groove pair of the driven coupler. The drive shaft/half-coupler transmits torque to the floating disc, which in turn rotates the driven half-coupler/shaft. During operation, the floating disc rotates about its center at the same speed as the driving and driven shaft, with the disc sliding on the grooves carrying out sliding-and-rotational motion to compensate for the shafts' radial misalignment. To reduce the friction losses and wear of mating surfaces, they are to be lubricated from time to time; for this purpose, special holes may be provided in the coupler's parts.

A drawback of the classical Oldham coupler design is that torque cannot be transmitted when the rotation axes of the driving and driven shaft deflect at a certain angle, i.e., the so-called angular displacement of the shafts. To solve some of the problems set in this invention, the Oldham coupler is improved so that a crusher transmission sub-assembly could be provided on its basis to transmit complex rotation with angular displacement of axes from the crusher drive to the unbalance bushing, while retaining such advantages of the classical Oldham coupler as simple design due to simplicity of its component parts, and reliability. Also, to solve some of the problems set in this invention, a counterbalance weight of an improved shape is installed inside the crusher body, becoming part of an integral "dynamic assembly."

The problems set are solved in an inertial cone crusher that includes a body with an outer cone resting upon the foundation via resilient dampers, and an inner cone located inside it on a spherical support, with an unbalance weight arranged on its drive shaft, its center of gravity adjustable relative to the rotation axis with the aid of a slide bushing, the unbalance weight's slide bushing being connected to a transmission coupler, through which torque from the engine is transmitted.

The inertial cone crusher has the following features:

- the transmission coupler is designed as a disc coupler comprising a driving half-coupler, a driven half-coupler, and a floating disc arranged between them, the driven half-coupler being rigidly connected to the unbalance weight's slide bushing, and the driving half-coupler being rigidly connected to a gear wheel, the latter being rigidly connected to a counterbalance weight, with the driving half-coupler, gear, and counterbalance weight mounted on the bushing so that the driving half-coupler, gear, counterbalance weight, and slide bushing make an integral movable "dynamic assembly," which is mounted on the fixed rotation axis supported by a flange via a mounting disc, the flange being rigidly fixed in the bottom part of the crusher's body.

The inertial cone crusher has the following additional features:

The transmission coupler includes disc-shaped driving half-coupler connected to the gear via a mounting disc and having a concave working end surface and a concave geometry of a dowel pin arranged on it radially, the disc-shaped driving half-coupler connected to the slide bushing of the counterbalance weight having a convex working end surface and a convex geometry of a dowel pin arranged on it radially, and a floating disc arranged between the half-couplers and having a convex end surface facing the drive half-coupler, and a convex geometry of a groove arranged on it radially, a concave end surface facing the driven half-coupler, and a concave geometry of a groove arranged on it radially, the grooves being perpendicular to each other.

The drive and driven half-couplers and the floating disc have round oil holes provided at the centers of the respective discs, the oil hole of the floating disc being of a larger diameter than the oil holes in the half-couplers. The dowel pins on the driving and driven half-coupler may be one-piece, with a thinning at the center above the oil holes. The dowel pins on the driving and driven half-coupler may be discontinued at the center, above the oil holes. The floating disc has oil ducts provided on both disc surfaces and shaped as radial grooves and a circular groove.

The diameter of the driving half-coupler is larger than the diameter of the driven half-coupler and the diameter of the floating disc. The driving half-coupler has mounting holes along the disc periphery, coinciding with the mounting holes along the inner rim of the gear wheel, coinciding with the mounting holes around the inner mounting hole of the counterbalance weight. The driven half-coupler has mounting holes along the disc periphery, coinciding with the mounting holes along the edge of the counterbalance weight slide bushing.

The concavity and convexity radiuses of the mating end surfaces of the coupler discs are equal, and the centers of all the radiuses are located at one point, which coincides with the center of the curvature radius of the inner surface of the inner cone's spherical support. The counterbalance weight is made as a disc segment, with a mounting hole equal to the outer diameter of the slide bushing at its center and with mounting holes at its edges, the upper surface of the disc having two rectangular reducing shoulders and the lower surface of the disc having a conical shoulder to suit the flange's mounting fasteners.

The counterbalance weight may have two locator end flats. The mounting disc is made as a thin disc with an oil hole at its center. The rotation axis is designed as a cylinder with an oil hole at its center and a round recess on the upper end, of a diameter equal to the diameter of the mounting disc. The flange is designed as a disc with a central hole, of a diameter equal to the outer diameter of the rotation axis; it has mounting holes at the disc edges. The rotation axis and the flange may be made as an integral part. The rotation of the "dynamic assembly" and the transmission coupler may be directed any way.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
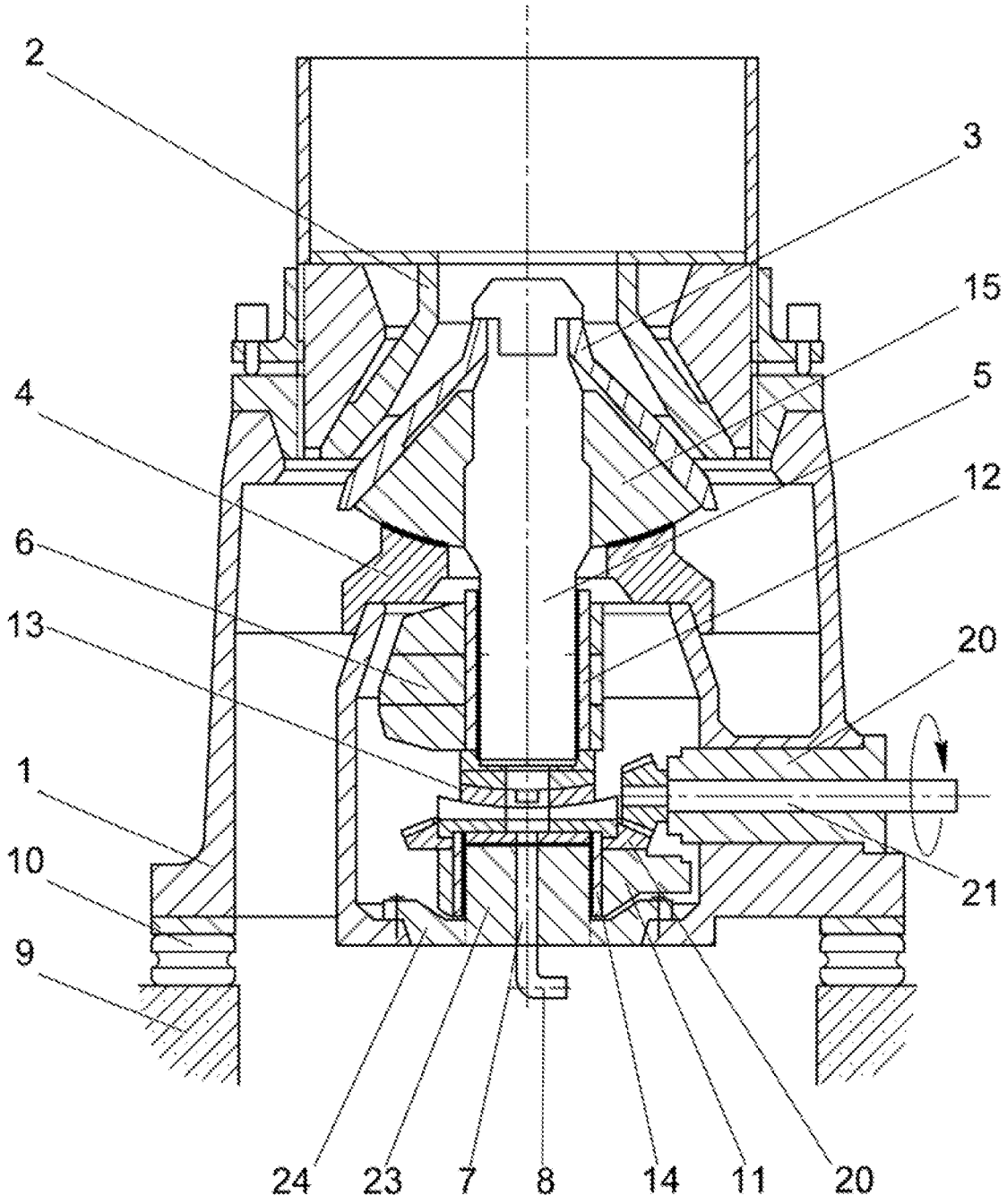
FIG. 1 shows the cross-sectional diagram of the inertial cone crusher.

The invention may be structurally embodied as follows, see FIG. 1:

Body 1 is installed upon foundation 9 via resilient dampers 10. Outer crushing cone 2 and inner crushing cone 3 mounted upon supporting cone 15 form a crushing chamber between them. The supporting cone 15 rests on spherical support 4. An unbalance weight slide bushing 12 and unbalance weight 6 are installed on shaft 5 of the supporting cone 15. The bushing is rigidly connected to transmission coupler 13.

Figure 2:
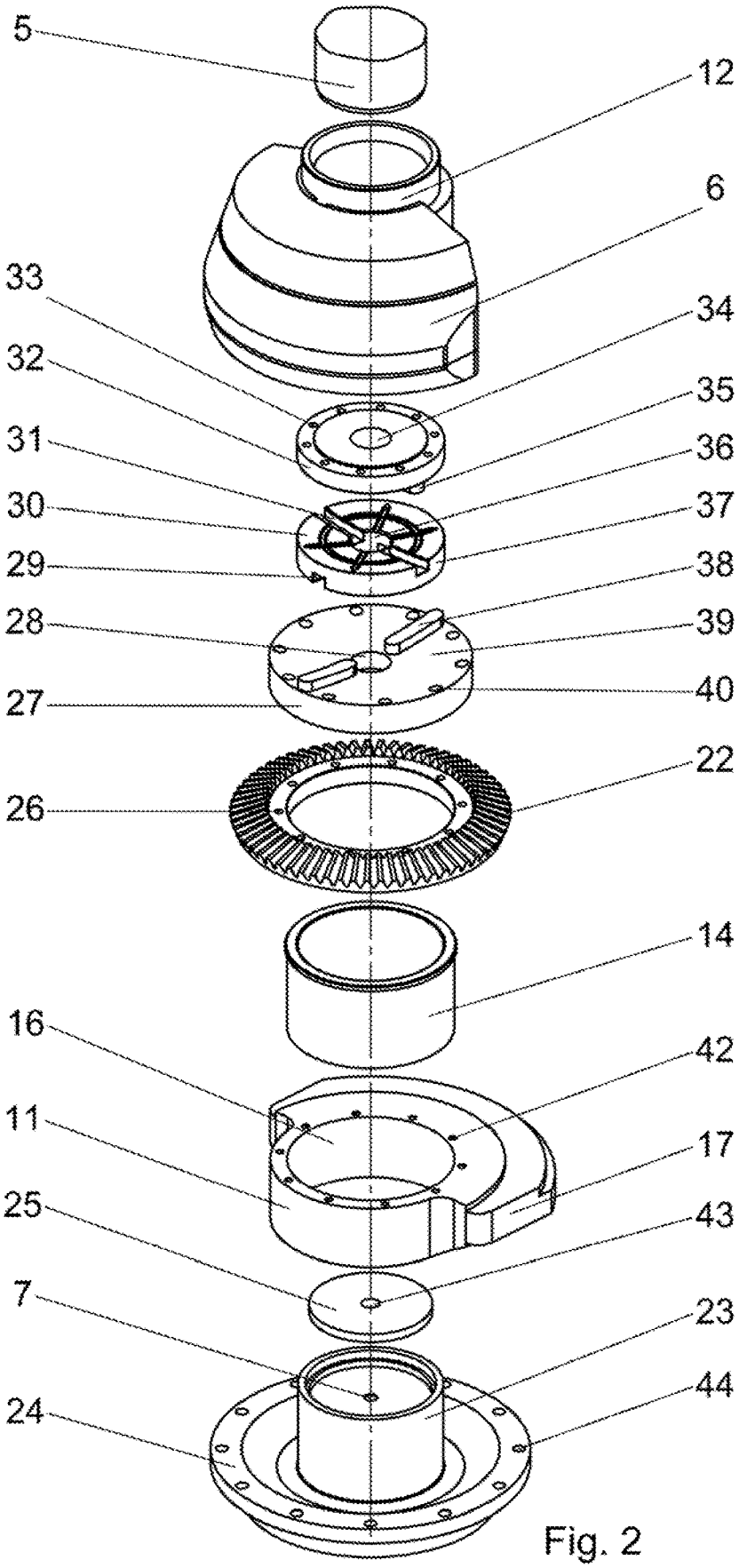
FIGS. 2 and 3 show the "dynamic assembly" and the crusher components mating to it.
Figure 3:
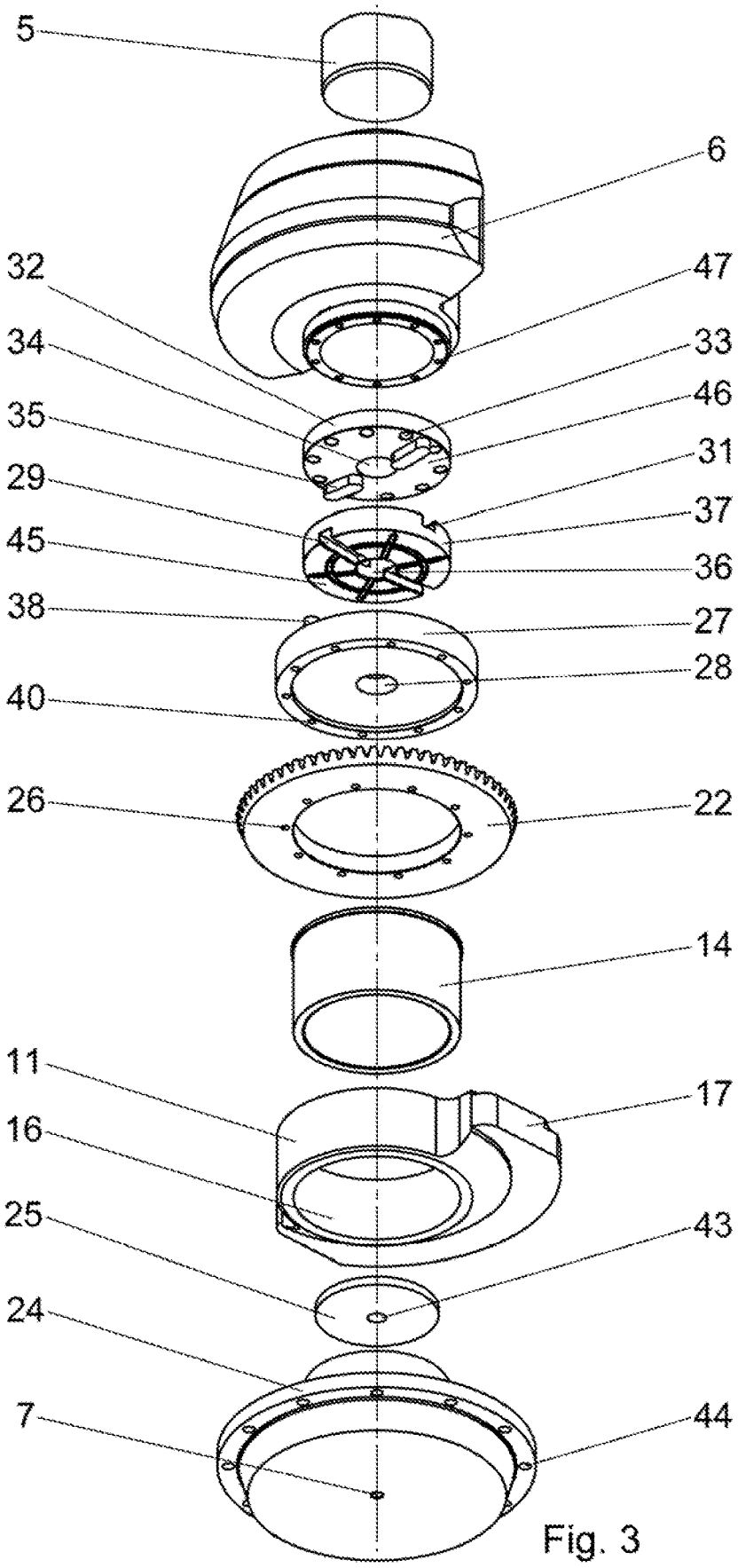

The transmission coupler 13 comprises driving half-coupler 27 and driven half-coupler 32 and floating disc 30, whose design is presented in detail in FIGS. 2 and 3. Driving the half-coupler 27 is a disc with a concave working end surface 39, on which concave dowel pin 38 is provided; oil hole 28 is at the center of the disc, and mounting holes 40 are arranged along the disc periphery. The reverse end surface of the disc has a recess whose diameter is equal to the diameter of mounting disc 25.

The driven half-coupler 32 is a disc with convex working end surface 46, where a convex pin 35 is arranged, an oil hole 34 is at the center of the disc, and mounting holes 33 are arranged along the disc periphery. The reverse end surface of the disc has a bulge whose diameter is equal to the inner diameter of the unbalance weight slide bushing 12. The floating disc 30 has convex end surface 45 facing the driving half-coupler 27, and the convex geometry of groove 29 arranged thereon; the concave end surface 30 facing the driven half-coupler 32, and a concave geometry of groove 31 provided thereon, and oil hole 36 at the center of the disc. Grooves 29 and 31 are arranged perpendicular to each other.

The floating disc 30 has oil duct grooves on both disc surfaces and provided as four radial fillets and one circular fillet.

Figure 4:
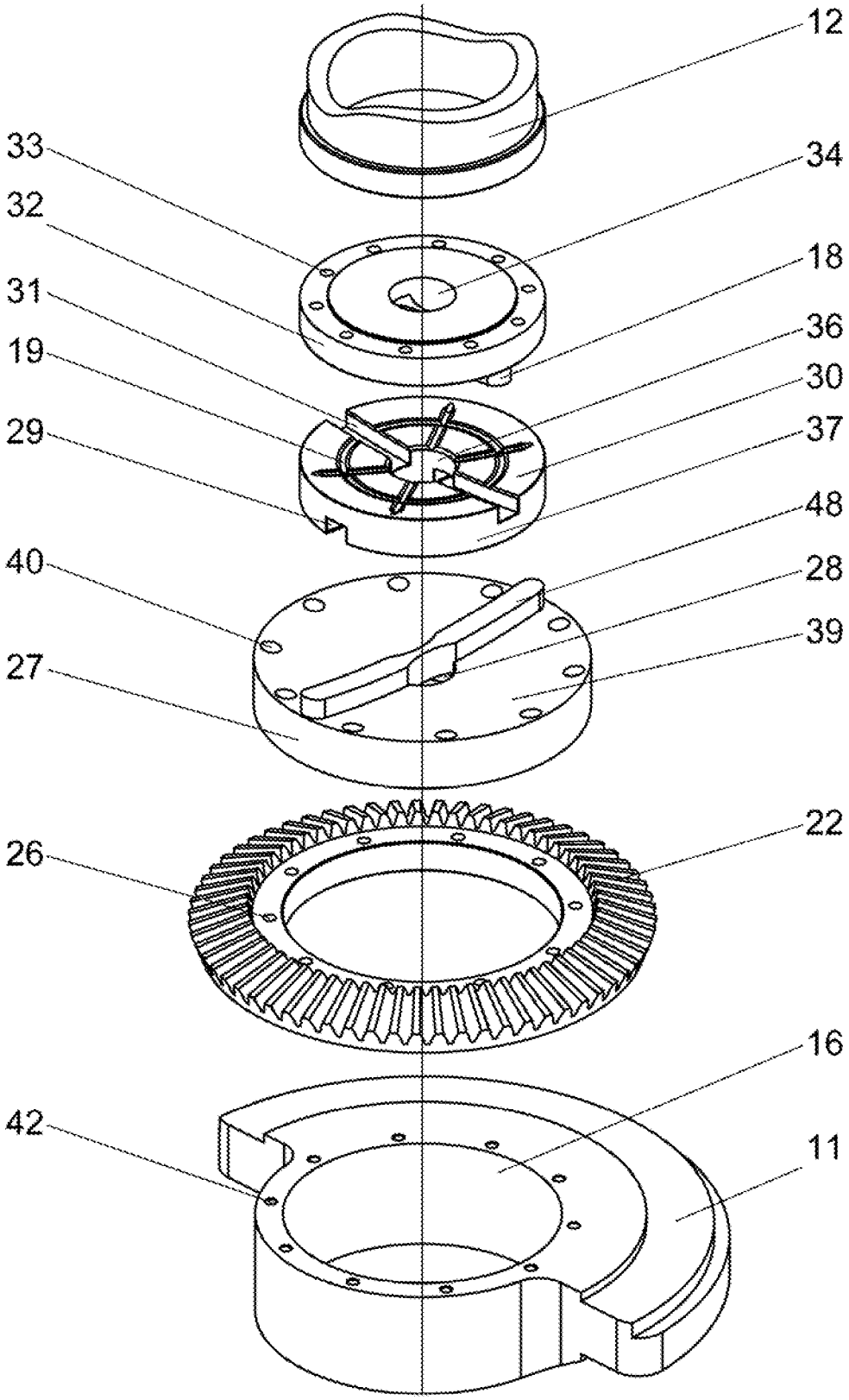
FIGS. 4 and 5 show an embodiment of the transmission coupler and counterbalance weight.
Figure 5:
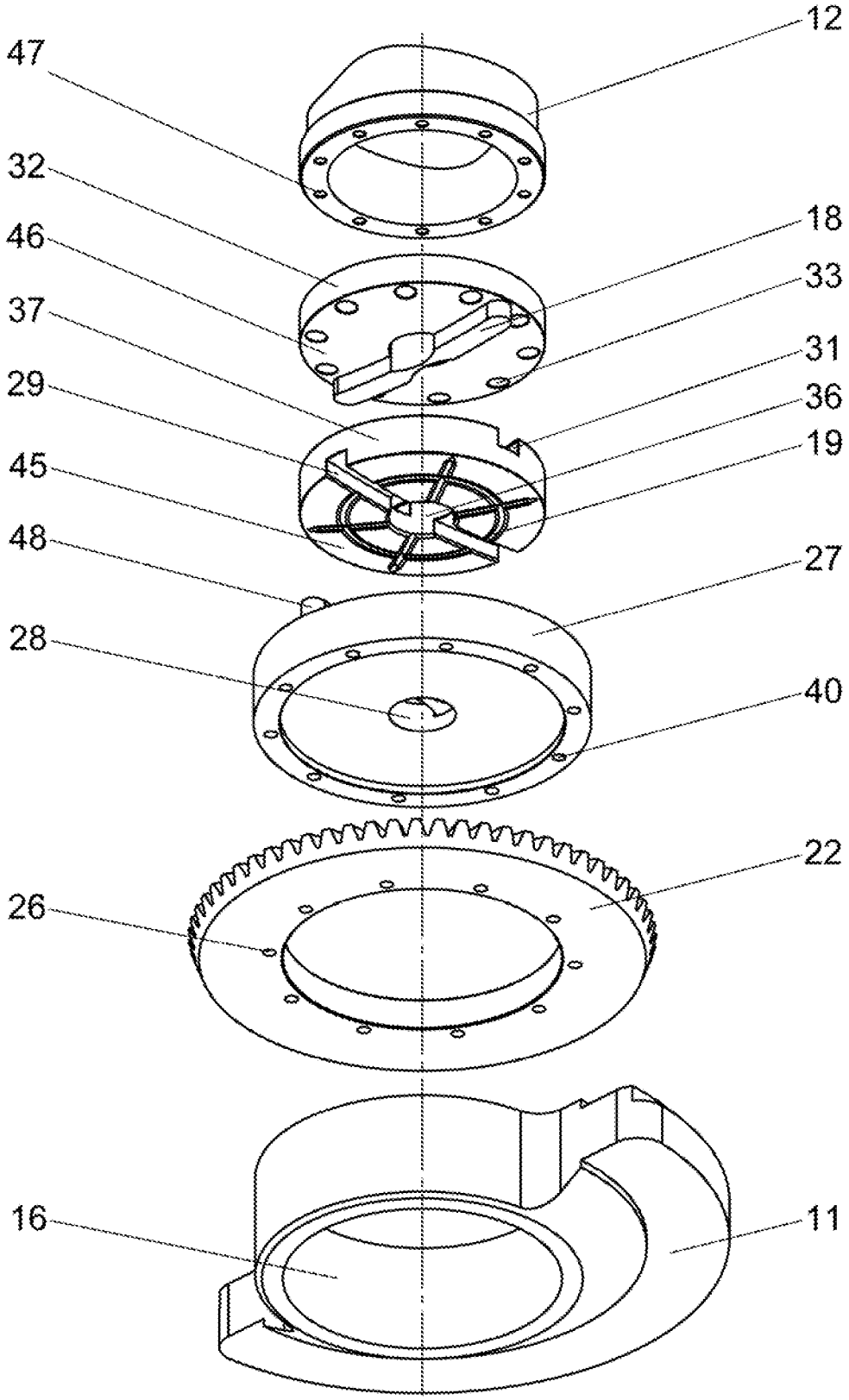
Figure 6:
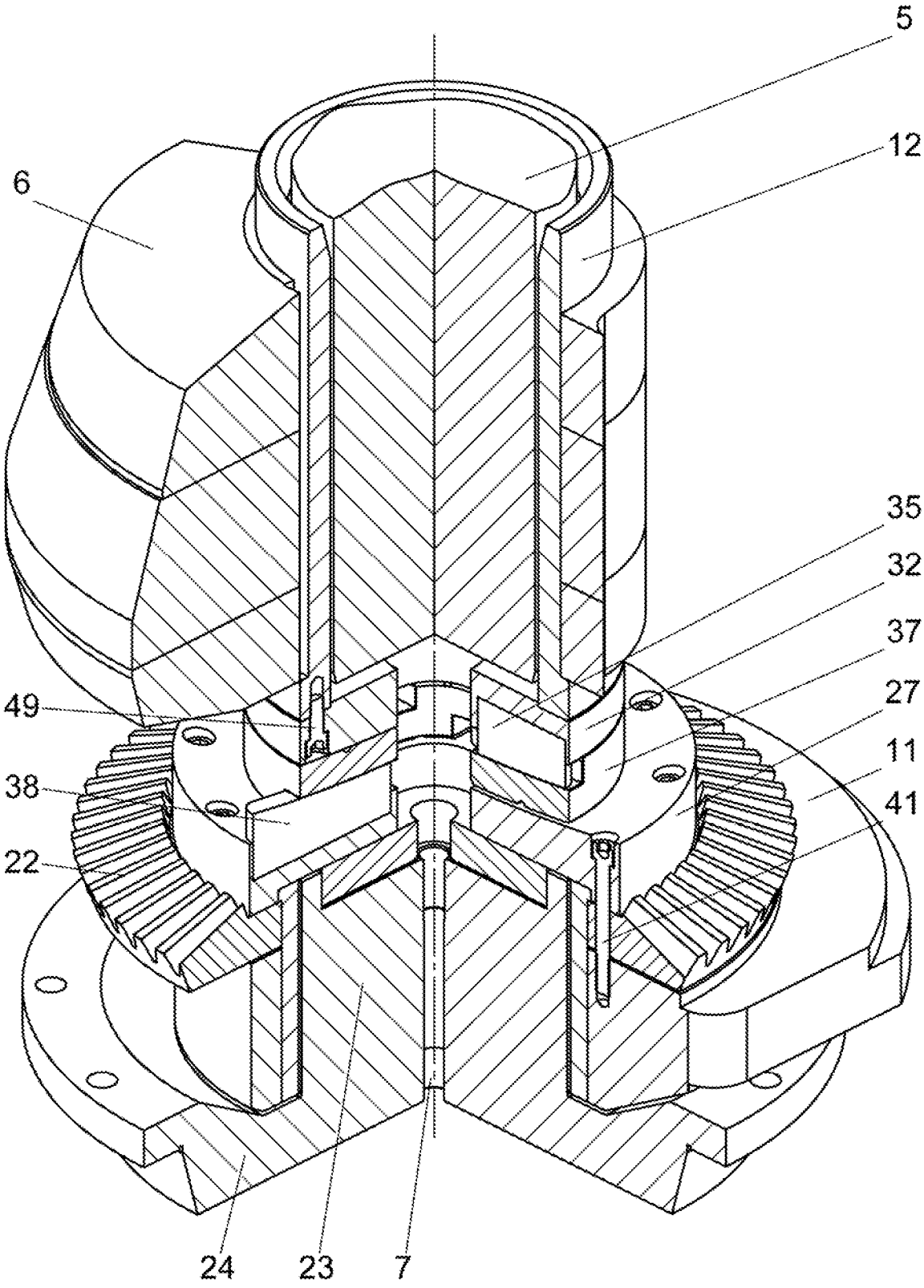
FIG. 6 shows the "dynamic assembly" as assembled, in one-fourth cutaway isometric view.

The half-couplers 27 and 32 and the floating disc 30 mate each other with their concave-convex end surfaces so that the half-couplers' dowel pins should tightly enter the respective grooves of the floating disc: the pin 38 enters the groove 29, and the pin 35 enters the groove 31. The oil holes are arranged above each other, the oil hole of floating disc 36 is of a greater diameter than the oil holes 28 and 34 in the half-couplers. The half-couplers' pins may be made separate, with a break above the oil holes (FIGS. 2 and 3) or one-piece with a thinning at the center, in way of the oil holes (FIGS. 4 and 5). On the one hand, one-piece pins provide a greater pin-groove engagement area, thus providing a higher reliability at a higher torque, but on the other hand, they partially overlap the oil holes.

The unbalance weight slide bushing 12 has mounting holes 47 at the rim edge, with the aid of which it is rigidly connected to the driven half-coupler 32 via its mounting holes 33 with fastening bolts 49.

The driving half-coupler 27 has mounting holes 40, with the aid of which it is rigidly connected to the gear 22 via the mounting holes 26 at the edges of its central mounting hole, and to the counterbalance weight 11 via mounting holes 42 with the fastening bolts 41. Simultaneously, the parts 27, 22 and 11 are tightly fitted on the bushing 14 making one body of rotation with it.

Thus, the driving half-coupler 27, gear 22, the counterbalance weight 11 and the bushing 14 form a movable "dynamic assembly," all the components of which are rigidly connected to each other.

The "dynamic assembly" is mounted on a fixed rotation axis 23 via the mounting disc 25 rotatable about it, for which purpose the bushing 14 is put on the rotation axis 23, a round recess equal to the diameter of the mounting disc 25 is provided on the top end of the rotation axis 23, and a recess equal to the outer diameter of the bushing 14 is provided on the driving half-coupler 27.

Thus, the mounting disc 25 is arranged between the upper end of the rotation axis 23 and the driving half-coupler 27, serving as a plain journal bearing for the entire "dynamic assembly." The rotation axis 23 rests upon the flange 24, which is rigidly fixed in the bottom part of the body 1 with the aid of mounting holes 44 and fastening bolts. The rotation axis 23 and the flange 24 may be provided as two different parts rigidly connected to each other, or as a one-piece part serving as a fixed bearing support for the "dynamic assembly."

An advantage of the one-piece solution of the support is a considerable improvement of the part's strength characteristics, since the axis and the flange receive a heavy dynamic load. A drawback of the solution is a higher cost of manufacturing of a complex integral part and of its installation. The movable "dynamic assembly" is mounted so that the unbalance weight 6 should always be in phase opposition to the counterbalance weight 11.

The counterbalance weight 11 is made as a disc segment, with the mounting hole 16 equal to the outer diameter of the slide bushing 14 at its center. Arranged at the central mounting hole 16 of the counterbalance weight 11 are the mounting holes 42 intended for building a "dynamic assembly." Provided on the top surface of the disc are two rectangular reducing shoulders to suit the inner surface pattern of the body 1. Provided on the bottom surface of the disc is a conical reducing shoulder to suit the surface pattern and locator fasteners of the flange 24 (FIGS. 4 and 5).

The counterbalance weight 11 may additionally have two locator end flats 17 (FIGS. 2 and 3) arranged on both sides of the disc and intended to facilitate installation of the counterbalance weight in the body when the required design diameter of the counterbalance weight disc is larger than the mounting apertures of the body of this standard size of the unit.

The complex shape of the counterbalance weight 11 is dictated by the compromise between the design of the inner profile of the body 1, or in other words, by the free space allocated for its accommodation, and characteristics of the counterbalance weight proper required to solve the problem of dynamic balance of the crusher. The counterbalance weight 11 is designed and arranged so that its gaps to the body 1 and the flange 24 should be minimal, which enables utilizing the body's space to the maximum without increasing the dimensions. The gear 22 engages the drive pinion shaft 21 mounted in the body 20 of the pinion shaft and connected to the engine (not shown in the figures).

The invention works as follows.

Torque is transmitted from the engine to the drive pinion shaft 21 and to the gear 22. Together with the gear 22 the entire "dynamic assembly" is set in rotation, comprising also the slide bushing 14, the counterbalance weight 11 and the drive half-coupler 27 of the transmission coupler 13. Thus, the "dynamic assembly" rotates about fixed the rotation axis 23. The drive half-coupler 27 transmits torque to the floating disc 37 and the driven half-coupler 32 due to the pin-groove engagements. The driven half-coupler 32 transmits torque to the slide bushing of the unbalance weight 12 and to the counterbalance weight 6. The latter develops a centrifugal force, and via the shaft 5 makes the inner cone 3 roll on the outer cone 2 over a layer of material to be crushed. If the rotation axis 24 and the shaft 5 are arranged strictly on one centerline, the floating disc 37 carries out simple rotational motion repeating it after the drive half-coupler 27 and transmitting rotation to the driven half-coupler 32.

Figure 7:
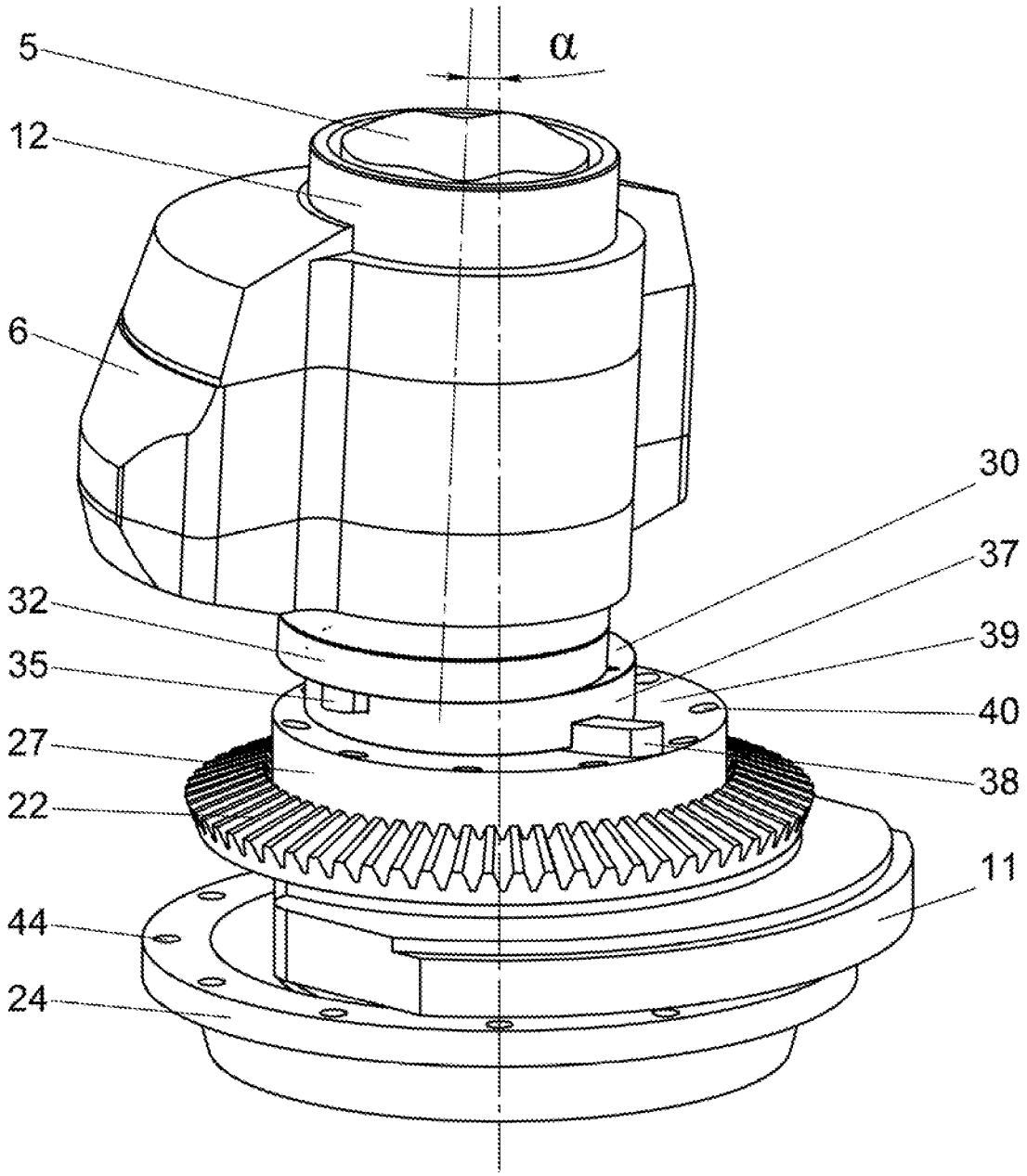
FIG. 7 shows the "dynamic assembly" in its operating position.

In the crusher's operating mode, the axis 24 and the shaft 5 have an angular difference $\alpha$ of rotation axes shown in FIG. 7; in this case, the floating disc 37 receives torque from the driving half-coupler 27 and carries out complex movement of rotation-sliding-swinging because the disc 37 proper rotates about its axis, the pins 38 and 35 slide in their respective grooves 29 and 31, and mating pairs of disc end surfaces 39, 45 and 30, 46 swing due to their concave-convex geometry. The operating angle of deflection $\alpha$ of the axes is in the range of 0° to 5°. The mating concave-convex end surfaces of the coupler discs tightly abut each other, since the curvature radiuses of the mating surfaces 39 and 45 are equal and the curvature radiuses of the mating surfaces 30 and 46 are equal, therefore the slide and swivel movement of the coupler discs creates no gap.

All the curvature radiuses of the mating surfaces are plotted from the same point as the curvature radius center of the inner surface of the spherical support 4 of the inner cone 3. Thus, the radius of the concave end surface 39 of the driving half-coupler 27 is greater than the radius of the convex end surface 46 of the driven half-coupler 32, which in turn is greater than the radius of the concave inner surface of the spherical support 4 of the inner cone 3. One-piece pins 18 and 48 of the half-couplers with a thinning at the center, in way of the oil holes (FIGS. 4 and 5), on the one hand, provide a greater pin-groove engagement area, thus providing a higher reliability at a higher torque, but on the other hand they partially overlap the oil holes. Therefore as an alternative, the half-couplers' dowels may be separate, with a break above the oil holes (FIGS. 2 and 3).

The design of components of the "dynamic assembly," and counterbalance weight 11 in particular, is calculated so that the center of gravity of its unbalanced mass should be positioned strictly at the center of the vertical generator line of the slide bushing 14. In this case, during the "dynamic assembly's" rotation, the load on the slide bushing 14 is distributed uniformly, thus, there is no load imbalance; thus, the wear of surfaces of the slide bushing 14 and the rotation axis 23 is uniform, and therefore the parts serve longer. All friction surfaces of the coupler need lubrication. Via oil tube 8, oil is fed under pressure to an oil duct 7 of the rotation axis 23, and then to mounting disc 25 via its oil hole 43. Next, oil goes to the transmission coupler 13 via oil holes 28, 36 and 34 of the coupler discs; and via the friction surfaces of the mounting disc 25 to the surfaces between the slide bushing 14 and the rotation axis 23. The diameter of the oil hole 36 of the floating disc 37 is of a size exceeding the oil holes 28 and 34, and such that at any operating angle of deflection $\alpha$ of the floating disc 37 and the driven half-coupler 32 from the vertical axis, the oil holes are not overlapped and oil access to all mating surfaces of the coupler is retained.

If the transmission coupler is designed with one-piece dowel pins with a thinning (FIGS. 4 and 5), the ratios of dimensions of the oil holes and thinnings of the dowel pins are such that at any operating angle of deflection $\alpha$ the holes do not overlap and oil access to all mating surfaces of the coupler is retained.

The oil ducts of the floating disc additionally help to distribute oil among the coupler's mating surfaces, which is especially efficient at high-speed engine operation.

The rotation of the "dynamic assembly" may be directed any way. The rotation of the transmission coupler may be directed any way. The transmission coupler and "dynamic assembly" claimed in this invention have several considerable advantages compared to the use of a bearing and compensation ball coupler traditional for crushers, and conventional counterbalance designs.

First, the design of the claimed "dynamic assembly" is much simpler.

The central transmission link of the transmission coupler is a simple floating disc with curved end surfaces and two grooves, while a bearing and compensation ball coupler has a dumb-bell support spindle of a complex design as the transmission link, with six recess-ball pairs arranged simultaneously on both sides. The half-couplers used in the claimed coupler are simple discs with curved end surfaces and radially arranged dowel pins, while the bearing and compensation ball coupler has half-couplers shaped as complex hollow cylinders with a bottom and with semi-cylindrical grooves provided on their inner surface and precisely oriented at the recess-ball pairs.

Second, the design of the claimed "dynamic assembly" is much more reliable.

The pin-groove structural mating can withstand greater loads for longer periods than the groove-ball-recess linking. Thus, the transmission coupler can work longer transmitting a higher torque without risk of emergency breakdown, and therefore a more powerful drive engine can be used with the same performances of the crushing unit.

Grouping several key parts of the machine into one "dynamic assembly" also enhances reliability and strength. Thus, the same crusher unit provided with the claimed "dynamic assembly" can operate in a wider range of outputs and loads, which makes it a more universal machine.

Thirdly, the claimed "dynamic assembly" allows to reduce the crusher's height.

The vertical dimension of the claimed coupler is smaller than the vertical dimension of the bearing and compensation ball coupler by about one half, therefore the structural section of the crusher body allocated for the transmission subassembly is proportionally smaller. The design of a counterbalance weight strictly fitted in its allocated body space, and absence of a counterbalance weight arranged outside the body also influence the height of the unit. The "dynamic assembly" design is compact and enables combining solutions to several problems at once in one assembly.

The implementation of this invention will make the entire crusher unit lower by about 20 percent of the initial height.

Fourth, the proposed "dynamic assembly" will allow to cut down the crusher's price.

The production cost of the transmission coupler, due to its design simplicity, is considerably lower than the cost of a traditional coupler; the cost saving from simplified installation and a lower body should also be considered. As a result, the total cost of the crusher unit may be reduced by about 5-10 percent.

Fifth, the proposed "dynamic assembly" allows a reduction of the crusher's service costs.

All the parts of the transmission coupler and the "dynamic assembly" can easily be separated and replaced irrespective of each other, without disassembling other parts of the machine, which is guaranteed by a simple technique of coupler discs attachment to the load-bearing parts of the unit. The coupler status and wear degree can be visually monitored through an inspection hole in a side of the body. Thus, the claimed coupler requires facilitated maintenance, which is much less costly and more convenient in field conditions. The area below the crusher body level is made free of the counterbalance weight assembly and of other driving elements, so that there is no need to expand the unloading chute area, and no need to provide "bottom access" for maintenance: for the claimed design, maintenance is from above only, which is more practical. The overall saving on the unit maintenance costs may reach up to 10 percent depending on the version selected.

Sixth, the proposed designs of the transmission coupler and "dynamic assembly" are universal and may be used in an inertial cone crusher of any standard size, from small laboratory units to large quarry machines.

Having thus described a preferred embodiment, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. An inertial cone crusher comprising:

a body with an outer cone resting upon a foundation via resilient dampers, and an inner cone arranged inside the outer cone on a spherical support, on whose drive shaft an unbalance weight is arranged using a first slide bushing, wherein a center of gravity of the unbalance weight is adjustable relative to a rotation axis, wherein the unbalance weight includes the first slide bushing connected to a transmission coupler, wherein torque from an engine is transmitted through the transmission coupler, and wherein the transmission coupler is a disc coupler including a driving half-coupler, a driven half-coupler, and a floating disc arranged between them, wherein the driven half-coupler is rigidly connected to the first slide bushing, and the driving half-coupler is rigidly connected to a gear, and wherein the gear is rigidly connected to a counterbalance weight, with the driving half-coupler, the gear, and the counterbalance weight installed on a second slide bushing so that the driving half-coupler, the gear, the counterbalance weight, and the second slide bushing form a single dynamic assembly, wherein the dynamic assembly is mounted, via a mounting disc, on the rotation axis resting on a flange, while the flange is rigidly fixed in a bottom part of the body.

2. The inertial cone crusher of claim 1, wherein the transmission coupler comprises:

a driving half-coupler shaped as a disc and connected to the gear via the mounting disc, wherein the driving half-coupler has a concave working end surface and concave geometry of a first dowel pin arranged radially on the driving half-coupler;

a driven half-coupler shaped as a disc and connected to the first slide bushing, the driven half-coupler having a convex working end surface and convex geometry of a second dowel pin arranged radially on the driven half-coupler; and a floating disc arranged between the half-couplers and having a convex end surface facing the driving half-coupler and convex geometry of a first groove provided radially on the convex end surface, a concave end surface facing the driven half-coupler, and concave geometry of a second groove provided radially on the concave end surface and perpendicular to the first groove.

3. The inertial cone crusher of claim 1, wherein the driving half-coupler and the driven half-coupler and the floating disc have round oil holes arranged at the centers of the respective discs, the oil hole of the floating disc having a larger diameter than the oil holes in the driving and driven half-couplers.

4. The inertial cone crusher of claim 3, wherein the first and second dowel pins are provided with a thinning above the oil holes.

5. The inertial cone crusher of claim 3, wherein the first and second dowel pins have gaps in the middle above the oil holes.

6. The inertial cone crusher of claim 1, wherein the floating disc has oil duct grooves arranged on both disc surfaces and provided as radial fillets and a circular fillet.

7. The inertial cone crusher of claim 1, wherein a diameter of the driving half-coupler is larger than a diameter of the driven half-coupler and larger than a diameter of the floating disc.

8. The inertial cone crusher of claim 1, wherein the driving half-coupler has mounting holes along its disc perimeter coinciding with the mounting holes along an inner rim of a gear wheel, and coinciding with the mounting holes around an inner mounting hole of the counterbalance weight.

9. The inertial cone crusher of claim 8, wherein the driven half-coupler has mounting holes along the disc perimeter coinciding with the mounting holes along an edge of the first slide bushing.

10. The inertial cone crusher of claim 1, wherein concavity and convexity radii of mating end surfaces of the coupler discs are equal, centers of all the radii are arranged at one point coinciding with a center of a curvature radius of the inner surface of the spherical support of the inner cone.

11. The inertial cone crusher of claim 1, wherein the counterbalance weight is shaped as a disc segment, with a mounting hole at its center equal to an external diameter of the slide bushing, with mounting holes provided at its edges, an upper surface of the disc having two rectangular reducing shoulders and a lower surface of the disc having a conical shoulder to match the flange's mounting fasteners.

12. The inertial cone crusher of claim 11, wherein the counterbalance weight has two locator end flats.

13. The inertial cone crusher of claim 1, wherein the mounting disc is a thin disc with an oil hole at its center.

14. The inertial cone crusher of claim 1, wherein the rotation axis is a cylinder with an oil hole at its center and a round recess in an upper end of a diameter equal to a diameter of the mounting disc.

15. The inertial cone crusher of claim 1, wherein the flange is a disc with a center hole of a diameter equal to an external diameter of the rotation axis, and has mounting holes at disc edges.

16. The inertial cone crusher of claim 1, wherein the rotation axis and the flange are provided as a single integral piece.

17. The inertial cone crusher of claim 1, wherein the rotation of the dynamic assembly and transmission coupler may be directed any direction.

18. An inertial cone crusher comprising:

an outer cone coupled to a foundation via resilient dampers;

an inner cone inside the outer cone on a spherical support, the inner cone including a drive shaft; and an unbalance weight mounted on the drive shaft using a first slide bushing, wherein a center of gravity of the unbalance weight is adjustable relative to a rotation axis, wherein the first slide bushing is connected to a disc coupler, wherein the disc coupler includes a driving half-coupler, a driven half-coupler, and a floating disc between them, wherein the driven half-coupler is rigidly connected to the first slide bushing, and the driving half-coupler is rigidly connected to a gear, wherein the gear is rigidly connected to a counterbalance weight, with the driving half-coupler, the gear, and the counterbalance weight installed on a second slide bushing forming a single dynamic assembly, and wherein the dynamic assembly is mounted, via a mounting disc, on the rotation axis resting on a flange, while the flange is rigidly fixed in a bottom part of the inertial crusher.

19. An inertial cone crusher comprising:

an outer cone coupled to a foundation via resilient dampers;

an inner cone inside the outer cone on a spherical support, the inner cone including a drive shaft; and an unbalance weight mounted on the drive shaft using a first slide bushing, wherein a center of gravity of the unbalance weight is adjustable relative to a rotation axis;

a disc coupler connected to the first slide bushing, wherein the disc coupler includes a driving half-coupler, a driven half-coupler, and a floating disc between them, wherein the driven half-coupler is rigidly connected to the first slide bushing;

a gear rigidly connected to the driving half-coupler and to a counterbalance weight; and the driving half-coupler, the gear, and the counterbalance weight forming a single dynamic assembly, wherein the dynamic assembly is mounted, via a mounting disc, on the rotation axis that rests on a flange.

* * * * *